United States Patent [19]

Burkland et al.

[11] 4,454,732

[45] Jun. 19, 1984

[54] COMBINED APPLIANCE WITH UNIFYING SUPPORT STRUCTURE

[75] Inventors: Charles W. Burkland; William J. Noe, both of Newton, Iowa

[73] Assignee: The Maytag Company, Newton, Iowa

[21] Appl. No.: 491,405

[22] Filed: May 4, 1983

[51] Int. Cl.[3] ..... D06F 39/00

[52] U.S. Cl. ..... 68/3 R; 68/19.2; 248/639; 248/676

[58] Field of Search ..... 68/3 R, 19.2; 248/639, 248/676; 134/115 R

[56] References Cited

U.S. PATENT DOCUMENTS

| | | | |
|---|---|---|---|
| 1,450,808 | 4/1923 | Huenergardt | 248/676 X |
| 2,793,518 | 5/1957 | Geldhof | 68/19.2 |
| 2,833,137 | 5/1958 | Geldhof | 68/19.2 |
| 2,866,273 | 12/1958 | Geldhof | 68/20 X |
| 3,139,744 | 7/1964 | Van Alstyne et al. | 68/20 |
| 3,150,904 | 9/1964 | Kendt et al. | 134/115 R X |
| 3,611,756 | 10/1971 | Brucken | 68/3 R |
| 3,670,746 | 6/1972 | Gehrmann | 134/115 R |

FOREIGN PATENT DOCUMENTS

| | | | |
|---|---|---|---|
| 52-77467 | 6/1977 | Japan | 68/3 R |

*Primary Examiner*—Philip R. Coe
*Assistant Examiner*—Frankie L. Stinson
*Attorney, Agent, or Firm*—Richard L. Ward

[57] ABSTRACT

A combined appliance is provided which includes unifying support structure. First and second appliances each have cabinets for enclosing the respective appliances. The first appliance is supported in an elevated posture on support structure including a pair of L-shaped support members. The second appliance is engageable with the floor and has side panels with lower recesses for receiving floor engaging portions of the support members. The lower recesses are in closely spaced juxtaposition to the surface engaging support members for stabilizing the first appliance and the support members. The side panels of the first and second appliances are substantially aligned with the sides of the L-shaped support members to provide the combination with the characteristics and stability of a unitary appliance.

9 Claims, 10 Drawing Figures

COMBINED APPLIANCE WITH UNIFYING SUPPORT STRUCTURE

BACKGROUND OF THE INVENTION

This invention relates generally to the field of appliance support structure and more particularly to structure for supporting a fabric dryer above a fabric washing machine in a stacked arrangement having the appearance and characteristics of a unitary appliance.

Prior art patents which show an arrangement of laundry appliances having the dryer mounted above the washing machine have either utilized full side panels as supporting structure for the dryer or have mounted the dryer directly to the washing machine.

Geldhof, U.S. Pat. No. 2,793,518, provides for mounting a dryer above a washer in such a manner that the washer is forwardly offset from the dryer to provide top access to the interior of the washer. The dryer is supported on the washer by a pair of side panels which are reinforced in the offset area.

Geldhof, U.S. Pat. No. 2,833,137, shows a dryer mounted above a washer through a compartment arrangement at the rear of the washing machine. The compartment houses part of the dryer blower system and the controls for both the washer and the dryer. The dryer is supported on the washer and not on a separate stand.

Geldhof, U.S. Pat. No. 2,866,273, shows a dryer supported on cabinet structure including side panels which engage the floor and which define a compartment for receiving the rear portion of a separately supported washer.

Van Alstyne et al, U.S. Pat. No. 3,139,744, disclose a dryer mounted above a movable washer on a pair of substantially parallel channel iron support walls.

Prior art thus generally includes the stacked arrangement of a dryer mounted to and/or above a washing machine. There has been no showing, however, of a stand-mounted dryer including structure having a mating relationship with the washing machine structure when the machines are assembled in a stacked arrangement to achieve a stabilizing of the dryer and support stand and the appearance and characteristics of a unitary structure.

SUMMARY OF THE INVENTION

It is therefore an object of the instant invention to provide an improved appliance support structure.

It is a further object of the instant invention to provide a combined appliance having the stability, appearance and characteristics of a unitary appliance.

Briefly, the instant invention achieves these objects in a combined appliance having unifying support structure including a pair of generally horizontally disposed base members engageable with a support surface. A generally upright column is associated with each of the base members defining a pair of L-shaped support assemblies. The L-shaped support assemblies are effectively joined in a generally vertical predetermined spaced-apart posture. A first cabinet encloses a first appliance and is supported on the upright columns. A second cabinet encloses a second appliance and is engageable with the support surface. The second cabinet defines lower recesses for receiving the base members of the support structure when the second appliance is positioned relative to the support structure and the exposed sides of the first and second appliances and the sides of the support structure are generally vertically aligned so that the support structure and cabinetry for the first and second appliances have the characteristics of a unitary appliance.

The various features of the combined appliance with unifying support structure and further objects and advantages thereof will become evident as the description proceeds and from an examination of the accompanying four sheets of drawings.

BRIEF DESCRIPTION OF THE DRAWINGS

The drawings illustrate a preferred embodiment of the invention with similar numerals referring to similar parts throughout the severals views, wherein.

DESCRIPTION OF A PREFERRED EMBODIMENT

Figure 1:
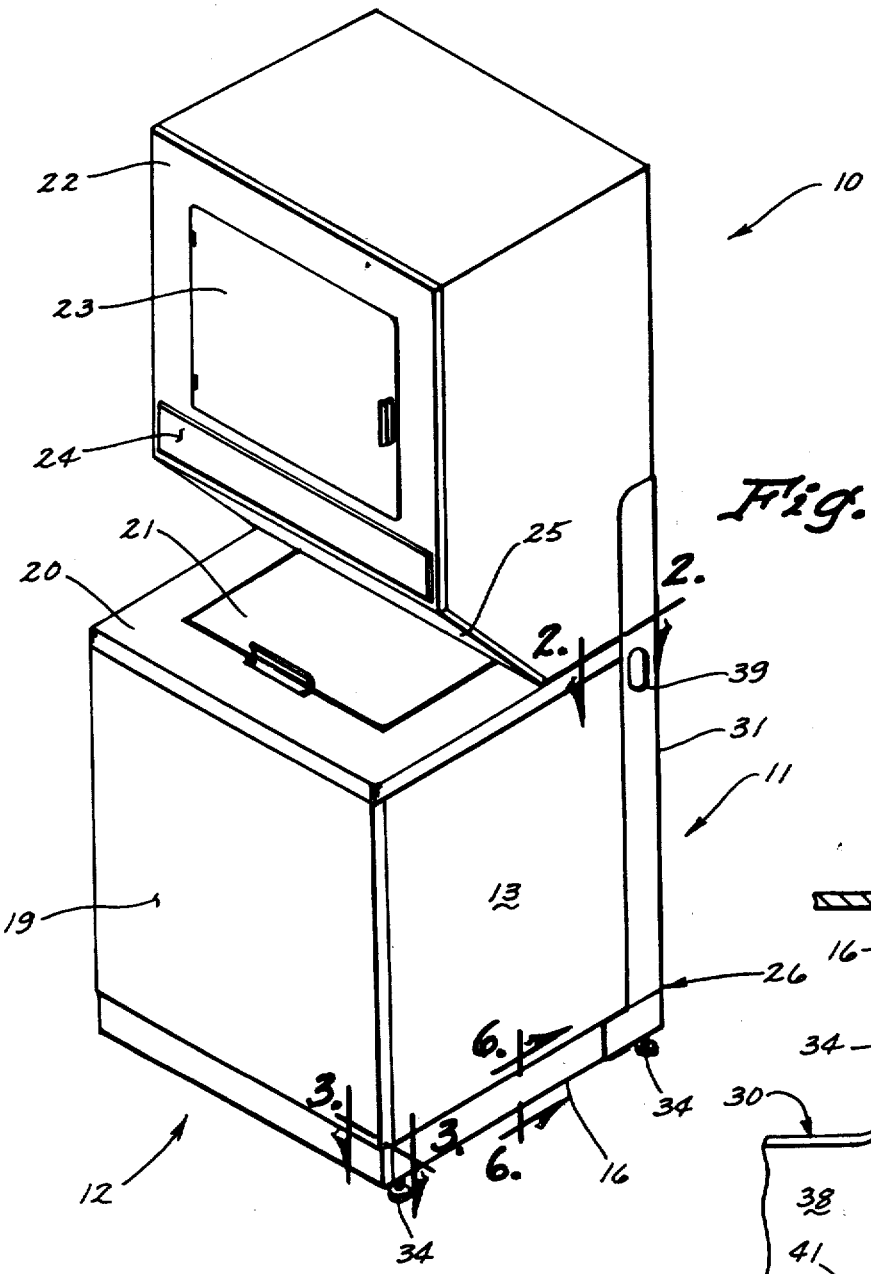
FIG. 1 is an isometric view of a washer/dryer pair mounted in a stack arrangement through supporting structure.

Referring now to the drawings and in particular to FIG. 1, there is shown a pair of laundry appliances with a fabric dryer 10 mounted on an appliance support stand 11 above an automatic washing machine 12.

Figure 3:
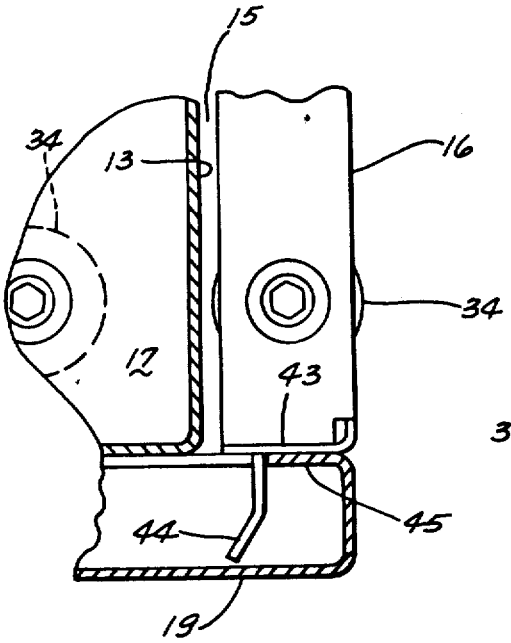
FIG. 3 is a fragmentary section view taken through the front panel of the washer and generally along lines 3—3 of FIG. 1 showing structure joining the base portions of the support stand.
Figure 6:
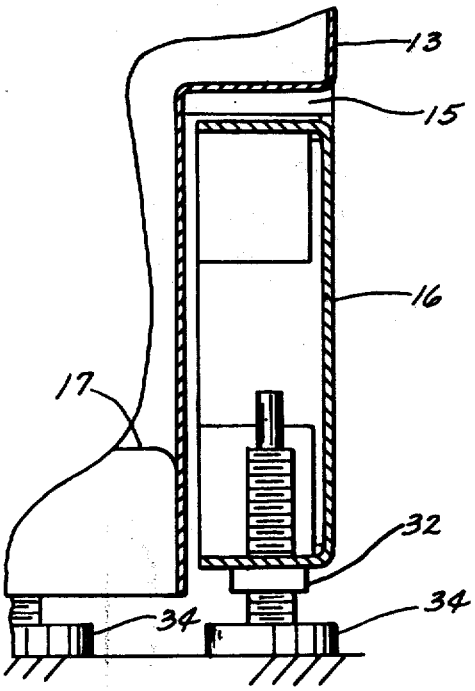
FIG. 6 is a fragmentary section view taken generally along lines 6—6 of FIG. 1.

Briefly, in this embodiment of the invention, the automatic washing machine 12 is housed within a generally rectangular cabinet having a three-sided enclosure member forming the side panels 13 and rear 14 of the cabinet and secured to a supporting base pan 17 as shown in FIGS. 3 and 6. Each side panel 13 of the enclosure member includes an outwardly facing rectangular recessed area 15 at the bottom, as best shown in FIG. 6, and extending from the front to the rear of the washing machine 12 for receiving the base portion 16 of the support stand 11 and which will be further described herein. A vertically oriented front panel 19 completes the peripheral cabinet enclosure including the frontal covering of the bottom recesses 15 on each side of the washing machine 12 as shown in FIGS. 1 and 3. The cabinetry of the washing machine 12 also includes a substantially horizontal top cover 20 having an access lid 21 for providing access to the interior of the washing machine 12.

The fabric dryer 10 is shown mounted in a cantilevered fashion on the support stand 11 directly above the washing machine 12 and also has a generally rectangular enclosure which is substantially shorter in front-to-rear depth than the washing machine 12. The vertically oriented dryer front panel 22 includes an access door 23 for loading and unloading fabrics to be dried. Controls, such as control panel 24, may be positioned on the dryer and/or washer through which the washing machine 12 and dryer 10 are controlled. As further shown in FIG. 1, the lower front panel portion 25 of the dryer 10 tapers rearwardly from a point adjacent the bottom edge of the control panel 24. The lower edge of the dryer lower front panel 25 and the base of the dryer 10 are adjacent to but spaced slightly above the top cover 20 of the washing machine 12. Within the lower part of the dryer 10 behind the sloping lower front panel 25 is the dryer heater assembly and drive assembly (not shown).

Figure 4:
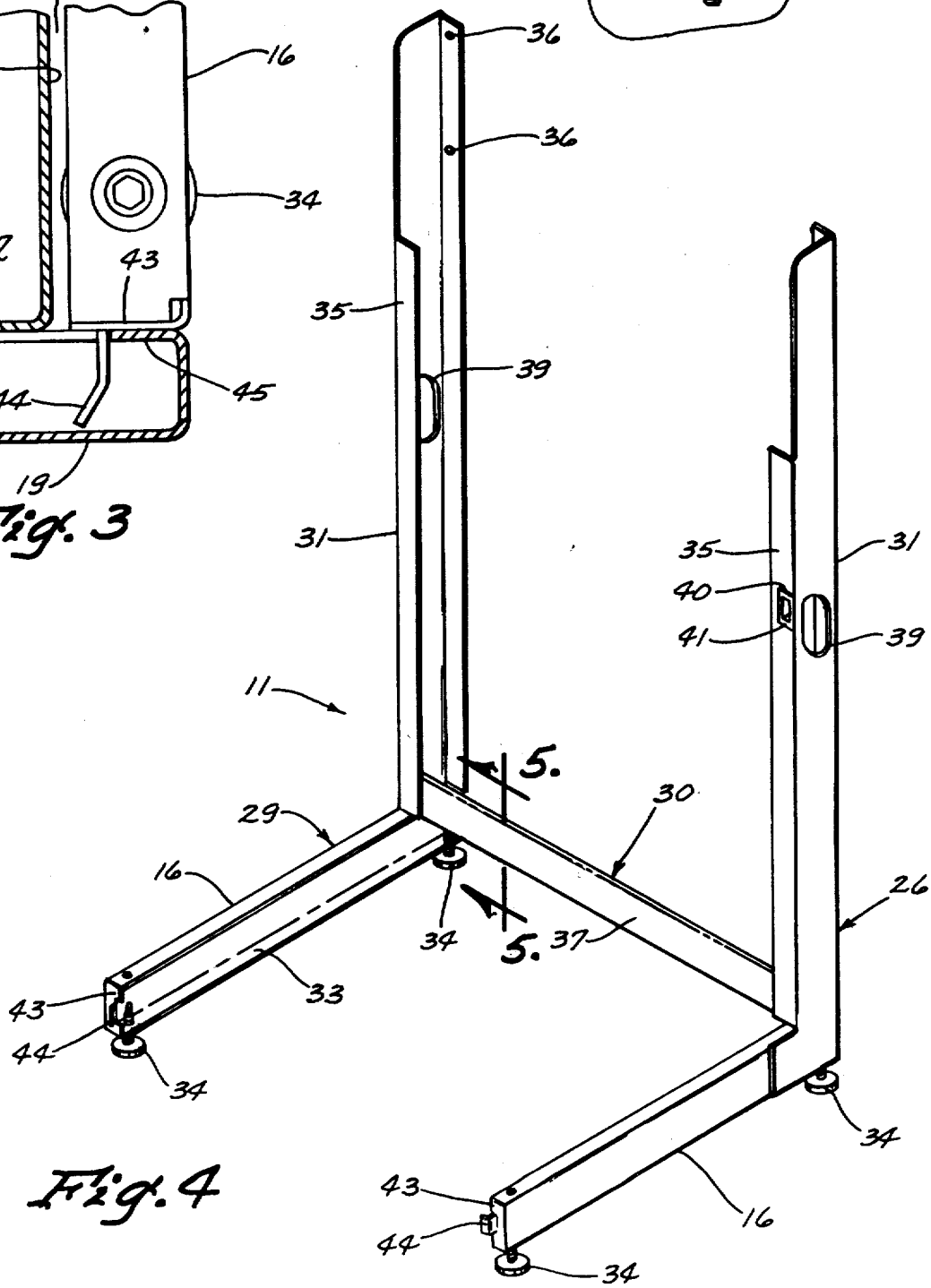
FIG. 4 is an isometric view of the support stand of the instant invention removed from the washer and dryer cabinetry.

Turning now to FIG. 4, there is shown the appliance support stand 11. The appliance support stand 11 is constructed of three main elements which include right and left leg assemblies 26 and 29 and a cross brace 30. The right and left leg assemblies 26 and 29 each include a substantially horizontally extending base portion 16 generally parallel with the supporting surface or floor at a substantially upright column portion 31 which combine to form the L-shaped right and left leg assemblies 26 and 29. In the construction of the instant embodiment, the base portion 16 and the upright column 31 of each leg 26 or 29 are constructed from substantially C-shaped channels which are formed from heavy gauge sheet metal with the upright column 31 being welded to the base portion 16. The open sides of the C-shaped channels which form the leg assemblies 26 and 29 are faced inwardly toward each other as shown in FIG. 4 so that the generally flat side of the channels will be substantially aligned with the vertical sides of the washing machine 12 and dryer 10 as best shown in FIGS. 1 and 6. As generally indicated in FIG. 6, each base portion 16 further includes a pair of spaced-apart weld nuts 32 welded to the bottom of the lower leg 33 of the C-shaped channel for receiving adjustable feet 34 as shown in FIGS. 4 and 6. These adjustable feet 34 are used to level the support stand with respect to the floor. As indicated in the fragmentary section views of FIGS. 3 and 6–10, the base support pan 17 of the washing machine 12 includes an adjustable support foot 34 at each corner for independently adjusting the height of the washing machine 12 with respect to the floor and the support stand 11.

Referring again to FIG. 4, the upright columns 31 each have the upper portion of the forwardly facing flange 35 of the C-shaped channel notched for receiving the dryer 10 in the manner of FIG. 1. The dryer 10 is secured to the top of and between the pair of upright columns 31 by threaded fasteners (not shown) which extend through the apertures 36 in each of the upright columns 31 as shown in FIG. 4.

As further shown in FIG. 4, the side wall of each upright column 31 includes an elongated opening or slot 39 for passing various service lines such as natural gas, electricity and water. In addition, the right-hand upright column 31 includes, in the forwardly facing flange 35 of the C-shaped channel, a generally rectangular slot 40 for receiving a thermoplastic grommet 41. The purpose of this grommet will be discussed further herein.

Figure 5:
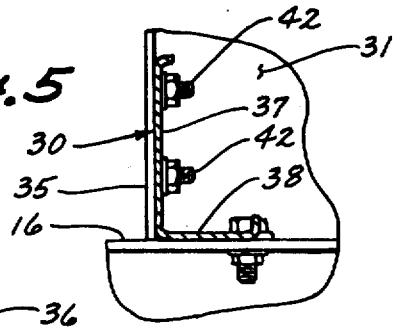
FIG. 5 is a fragmentary section view taken through the support stand cross brace generally along lines 5—5 of FIG. 4.

In this embodiment of the invention and as best shown in FIG. 5, cross brace 30, having a substantially L-shaped cross section, is bolted to the two leg assemblies 26 and 29 to form the support stand 11. The vertical leg 37 of the cross brace 30 is bolted to the upright columns 31 through a pair of weld studs 42 which are attached to the inside of the forwardly facing flange 35 and the horizontal leg 38 of the cross brace 30 is bolted to the base portion 16 at each side. Alternatively, the cross brace 30 could be welded to the leg assemblies 26 and 29 thus forming a permanent assembly of the support stand 11. The bolted construction is, however, preferred since it facilitates handling both in manufacturing and shipping.

Turning now to FIG. 6, it can be seen that the base portions 16 of the support stand 11 are accommodated within the substantially rectangular recesses 15 of the washing machine 12. As can be best seen in FIG. 1, the sides of the washing machine 12 the dryer 10 and the support stand 11 are all generally aligned in the same vertical plane.

Figure 10:
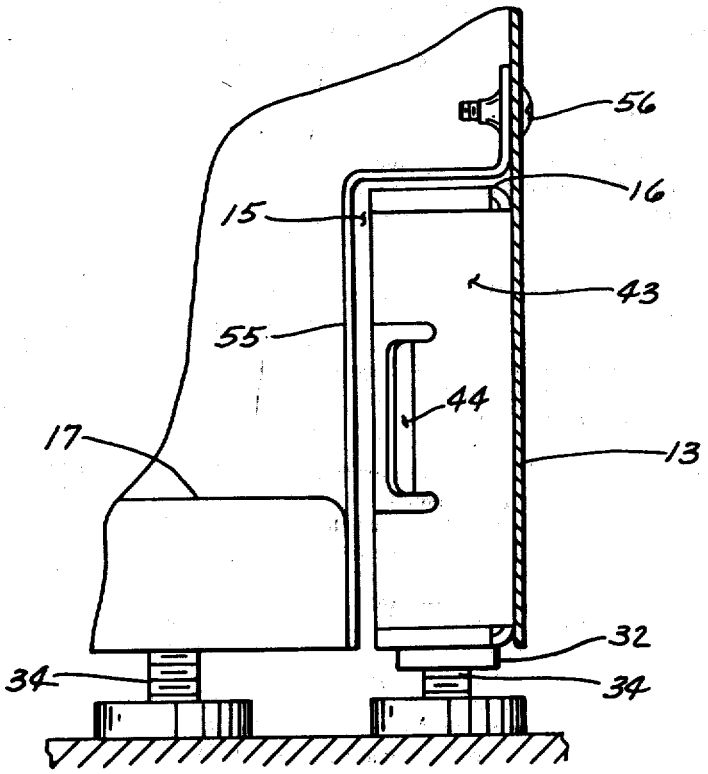
FIG. 10 is a view similar to FIG. 6 showing an alternate cabinet construction and including the front wall of the base portion of the support stand.

FIG. 10 shows an alternate embodiment in which the base portions 16 of the leg assemblies 26 or 29 are totally enclosed in the recesses 15. In this alternate embodiment, a bracket 55 is secured to the base support pan 17 by welding or otherwise mechanically fastening. The side wall 13 of the cabinet is extended downwardly along the outside of the base portion 16 and is secured to the bracket 55 by sheet metal screws 56.

Returning now to FIG. 3, each base portion 16 has a front wall 43 which includes a tab or finger 44 that extends forwardly and angles inwardly. When the washing machine 12 is positioned between the right and left legs 26 and 29 of the support stand 11 so that the base portions 16 of the right and left leg assemblies 26 and 29 are within the rectangular recesses 15 of the washing machine 12, the tabs or fingers 44 will engage with the return flanges 45 of the front panel 19 to structurally tie together the base portions 16. This will keep the base portions 16 of the leg assemblies 26 and 29 from spreading away from the washing machine 12.

Figure 2:
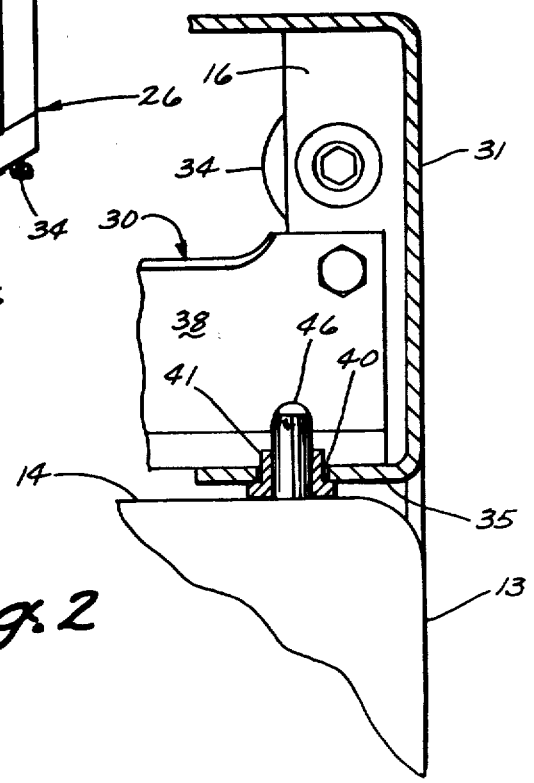
FIG. 2 is a fragmentary section view showing a portion of a support stand and the washer cabinet taken generally along lines 2—2 of FIG. 1.

As shown in FIG. 2, the upper right rear corner of the washing machine 12 includes a cylindrical pilot pin 46 which extends rearwardly from the washing machine 12. When the washing machine 12 is operably positioned with respect to the support stand 11, the pilot pin 46 will engage with the previously discussed thermoplastic grommet 41 in the forwardly facing flange 35 of the upright column 31. This pilot pin 46 serves as a locating device for the washing machine 12 and also stabilizes the dryer 10 and support stand 11 in a side-to-side direction. As previously discussed, the washing machine 12 includes a plurality of adjustable feet 34 for vertically adjusting the washing machine 12 with respect to the support stand 11.

Figure 7:
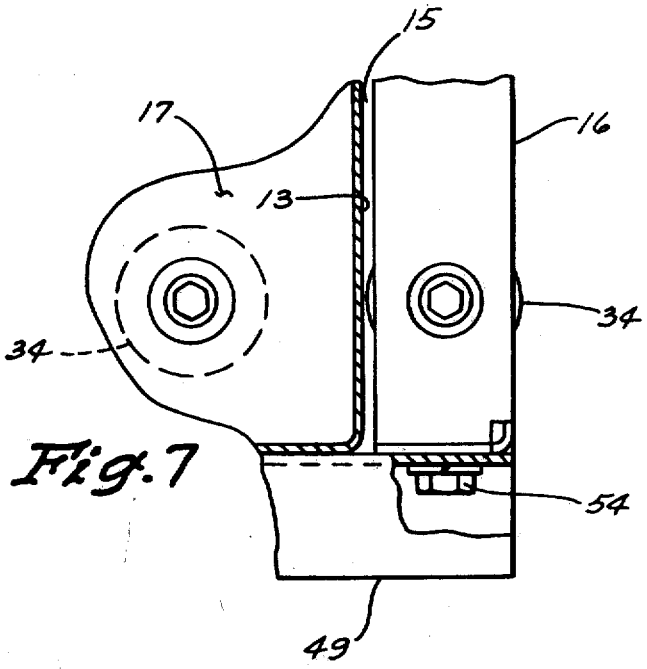
FIG. 7 is a fragmentary section view similar to FIG. 3 showing an alternate embodiment of structure joining the base portions of the support stand.

FIG. 7 shows an alternate to the tab 44 and front panel 19 construction of FIG. 3 for tying together the base portions 16 of the leg assemblies 26 and 29. In this alternate embodiment, the front panel is terminated vertically short of the base portions 16 and a separate sheet metal toe panel 49 is bolted through mechanical fasteners 54 across the front of the washing machine 12 after it has been positioned relative to the support stand 11.

Figure 8:
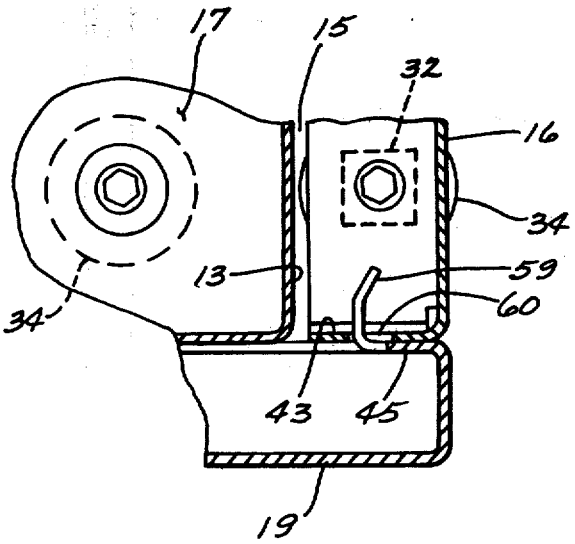
FIGS. 8 and 9 are views similar to FIG. 3 showing other alternate structures for joining the base portions of the support stand.
Figure 9:
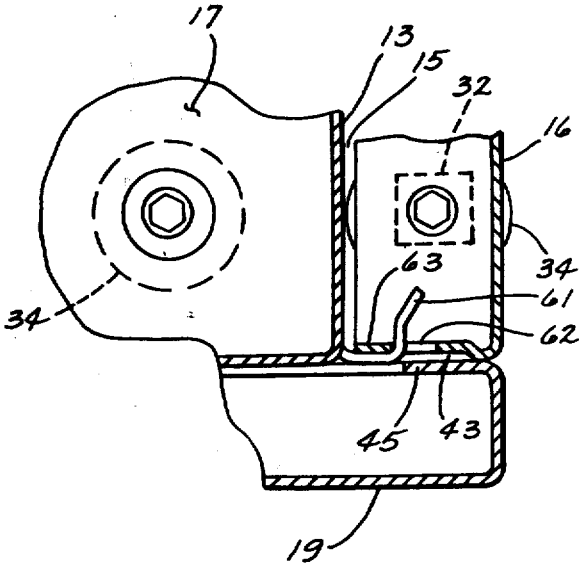

FIGS. 8 and 9 show still further alternate embodiments of the tab 44 and front panel 19 construction. FIG. 8 shows a simple reverse construction where a tab 59 is formed in the return flange 45 of the front panel 19 and a slot 60 is formed in the front wall 43 of the base portion 16. In the arrangement shown in FIG. 9, a tab 61 is lanced out of the side 13 and a slot 62 is formed in a recess portion 63 of the front wall 43 of the base portion 16.

Thus the instant invention provides a combined appliance having unifying support structure. A washing machine and a dryer each have cabinets for enclosing the separate appliances with the washing machine being operably positioned below the stand-mounted dryer. When assembled for operation, the top cover of the washing machine is spaced a predetermined distance below the bottom of the dryer. The dryer stand includes forwardly extending horizontal base portions which are received by recesses in the side panels of the washing machine. The front walls of the base portions include tabs which are engageable with slots in the front panel of the washing machine to structurally tie the base portions together. The washing machine also includes a cabinet mounted locating pin which is engageable with a vertical column of the dryer stand so that the combination of side panel recesses, front panel-base portion engagement and the locating pin provides stability and unity to the washer, dryer and stand arrangement. Further, the side panels of the washer, the dryer and the sides of the dryer stand are substantially aligned in a common vertical plane so as to present the combinatory appearance and characteristics of a unitary appliance.

In the drawings and specification, there is set forth a preferred embodiment of the invention and although specific terms are employed these are used in a generic and descriptive sense only and not for purposes of limitation. Changes in the form and proportion of parts as well as the substitution of equivalents are contemplated as circumstances may suggest or render expedient without departing from the spirit or scope of the invention as defined in the following claims.

We claim:

1. A combined appliance having unifying support structure, the combination comprising: support means including a pair of generally horizontally disposed base members engageable with a support surface, a generally upright column associated with each of said base members defining a pair of L-shaped support assemblies, and means for effectively joining said L-shaped support assemblies in a generally vertical predetermined spaced-apart posture; first cabinet means enclosing a first appliance and supported on said upright columns; and second cabinet means enclosing a second appliance and engageable with said support surface, said second cabinet means defining lower recesses for receiving the base members of said support means when said second appliance is positioned relative to said support means, the exposed sides of said first and second appliance means and the sides of said support means being generally vertically aligned whereby the support structure and cabinetry for said first and second appliances have the characteristics of a unitary appliance.

2. A combined appliance having unifying support structure as defined in claim 1 wherein said second cabinet means includes side panels defining said lower recesses and wherein said lower recesses are outwardly facing.

3. A combined appliance having unifying support structure as defined in claim 2 wherein said side panel recesses include generally horizontal portions overlying said base members in closely spaced juxtaposition to stabilize said first appliance and said support means.

4. A combined appliance having unifying support structure as defined in claim 1 and further including locating means having a first portion associated with said second appliance cabinet means and a second portion associated with one of said upright columns, said portions being engageable when said second appliance is positioned relative to said support means for sideways stabilizing said first appliance and said support means.

5. A combined appliance having unifying support structure as defined in claim 1 wherein said support means includes means for connecting said base members to said second cabinet means.

6. A combined appliance having unifying support structure, the combination comprising: first and second appliances each having cabinet means for supporting and generally enclosing the respective appliances; means for supporting said first appliance in an elevated position including a pair of generally L-shaped members, each of said L-shaped members comprising a generally horizontally extending base member engageable with a support surface and a generally upright column, said first appliance supporting means further including means for effectively joining said L-shaped support members in a generally vertical predetermined spaced-apart posture; means for supporting said first appliance cabinet means on said upright columns, said second appliance cabinet means being engageable with said support surface and having side panels defining lower outwardly facing recesses for receiving the base members of said first appliance supporting means in a generally mating relationship, said recesses including a generally horizontal portion overlying said base members in closely spaced juxtaposition to stabilize said first appliance and said first appliance supporting means, said cabinet means of said first and second appliances having side panels substantially aligned with the sides of said pair of L-shaped members to provide the combined first and second appliances with the characteristics and stability of a unitary appliance.

7. A combined appliance having unifying support structure as defined in claim 6 and further including means for connecting the front portions of said L-shaped members across the front of said second appliance including tabs associated with one of said base members or said cabinet means and mating slots associated with the other of said base members or said cabinet means.

8. A combined appliance having unifying support structure, the combination comprising: support means including a pair of L-shaped members generally vertically spaced apart in a predetermined posture and each having a substantially upright column and a generally horizontal base member extending forward from said upright column and engageable with a support surface, said support means further including means for effectively joining said L-shaped support members in said spaced-apart posture; a first appliance having cabinet means supported on said upright columns; a second appliance engageable with said support surface and positionable between said L-shaped support members, said second appliance including cabinet means having a front panel and side panels with a front-to-rear outwardly facing recess at the bottom of each side panel for receiving said horizontal base members in a generally mating relationship; connecting means associated with said front panel and said horizontal base members for maintaining the spaced-apart posture of said L-shaped members and for maintaining said horizontal base members in said mating relationship with said recesses; and locating means including a pilot pin associated with said second appliance cabinet means and a grommet associated with one of said upright columns, said pilot pin engageable with said grommet for locating and sideways stabilizing said first appliance and said support means, the exposed sides of said first and second appliances and the sides of said support means being generally vertically aligned whereby the support structure and cabinetry for said first and second appliances have the characteristics and stability of a unitary appliance.

9. A combined appliance having unifying support structure as defined in claim 8 wherein said connecting means includes toe panel means fastened across the front of said second appliance cabinet means to said horizontal bases for maintaining said mating relationship with said recesses.

* * * * *